US006257118B1

(12) United States Patent
Wilbur et al.

(10) Patent No.: US 6,257,118 B1
(45) Date of Patent: Jul. 10, 2001

(54) METHOD AND APPARATUS FOR CONTROLLING THE ACTUATION OF A HYDRAULIC CYLINDER

(75) Inventors: R. Carl Wilbur, Brimfield; John D. Duffy, Peoria; Douglas W. Koehler, Naperville, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/313,088

(22) Filed: May 17, 1999

(51) Int. Cl.[7] ..... F15B 13/16
(52) U.S. Cl. ..... 91/361; 91/363 R; 137/625.65
(58) Field of Search ..... 91/361, 363 K, 91/364, 435; 137/625.65

(56) References Cited

U.S. PATENT DOCUMENTS 5,189,940 3/1993 Hosseini et al. ..... 91/361
5,305,681 4/1994 Devier et al. ..... 91/361
5,383,390 1/1995 Lukich ..... 91/361
5,511,458 * 4/1996 Kamada et al. ..... 91/361
5,701,793 12/1997 Gardner et al. ..... 91/361

* cited by examiner

*Primary Examiner*—Edward K. Look
*Assistant Examiner*—Thomas E. Lazo
(74) *Attorney, Agent, or Firm*—David M. Masterson

(57) ABSTRACT

An apparatus controllably moves a moveable element within a hydraulic motor. A lever device establishes an operator command signal indicative of a desired velocity and direction of movement of the moveable element. A position sensor senses the position of the moveable element and produce a position signal. An electronic controller receives the operator command signal and position signal, determines the actual velocity of the moveable element, and determines a limit value in response to the actual velocity of the moveable element. Additionally, the controller compares the operator signal magnitude to the limit value and produces a flow control signal in response to the comparison. An electrohydraulic controller receives the flow control signal and responsively controls the movement of the moveable element.

17 Claims, 3 Drawing Sheets

METHOD AND APPARATUS FOR CONTROLLING THE ACTUATION OF A HYDRAULIC CYLINDER

TECHNICAL FIELD

This invention relates generally to an apparatus for controlling the actuation of a hydraulic cylinder and, more particularly, to an apparatus for limiting the velocity of the hydraulic cylinder piston as it nears an end of stroke.

BACKGROUND ART

Hydraulic systems are particularly useful in applications requiring significant power transfer and are extremely reliable in harsh environments, for example, in construction and industrial work places. Earthmoving machines, such as excavators, backhoe loaders, and wheel type loaders are a few examples where the large power output and reliability of hydraulic systems are desirable.

Typically, a diesel or internal combustion engine powers the hydraulic system. The hydraulic system, in turn, delivers power to the machine's work implement. The hydraulic system typically includes a pump for supplying pressurized hydraulic fluid and a directional valve for controlling the flow of hydraulic fluid to a hydraulic motor which in turn delivers power to a work attachment, e.g., a bucket.

Conventionally, such earth working machines include a mechanical cushion within the hydraulic cylinders to ease the shock when the hydraulic cylinder piston strikes a stroke end of the cylinder. Typically, an operator displaces a lever device to control the velocity of the hydraulic cylinder piston. If the operator fully displaces the lever, causing the piston to strike the stroke end, the mechanical cushion cannot completely absorb the inertial force of the impact, which subjects the cushion chamber to high pressures, adversely affecting the durability of the cylinder and leading to higher structural cost. In addition, the impact causes the machine body to shake, which can lead to operator discomfort.

The present invention is directed toward overcoming one or more of the problems as set forth above.

DISCLOSURE OF THE INVENTION

In one aspect of the present invention, an apparatus controllably moves a moveable element within a hydraulic motor. A lever device establishes an operator command signal indicative of a desired velocity and direction of movement of the moveable element. A position sensor senses the position of the moveable element and produces a position signal. An electronic controller receives the operator command signal and position signal, determines the actual velocity of the moveable element, and determines a limit value in response to the actual velocity of the moveable element. Additionally, the controller compares the operator signal magnitude to the limit value and produces a flow control signal in response to the comparison. An electrohydraulic controller receives the flow control signal and responsively controls the movement of the moveable element.

BRIEF DESCRIPTION OF THE DRAWINGS

For a better understanding of the present invention, reference may be made to the accompanying drawings in which.

BEST MODE FOR CARRYING OUT THE INVENTION

Figure 1:
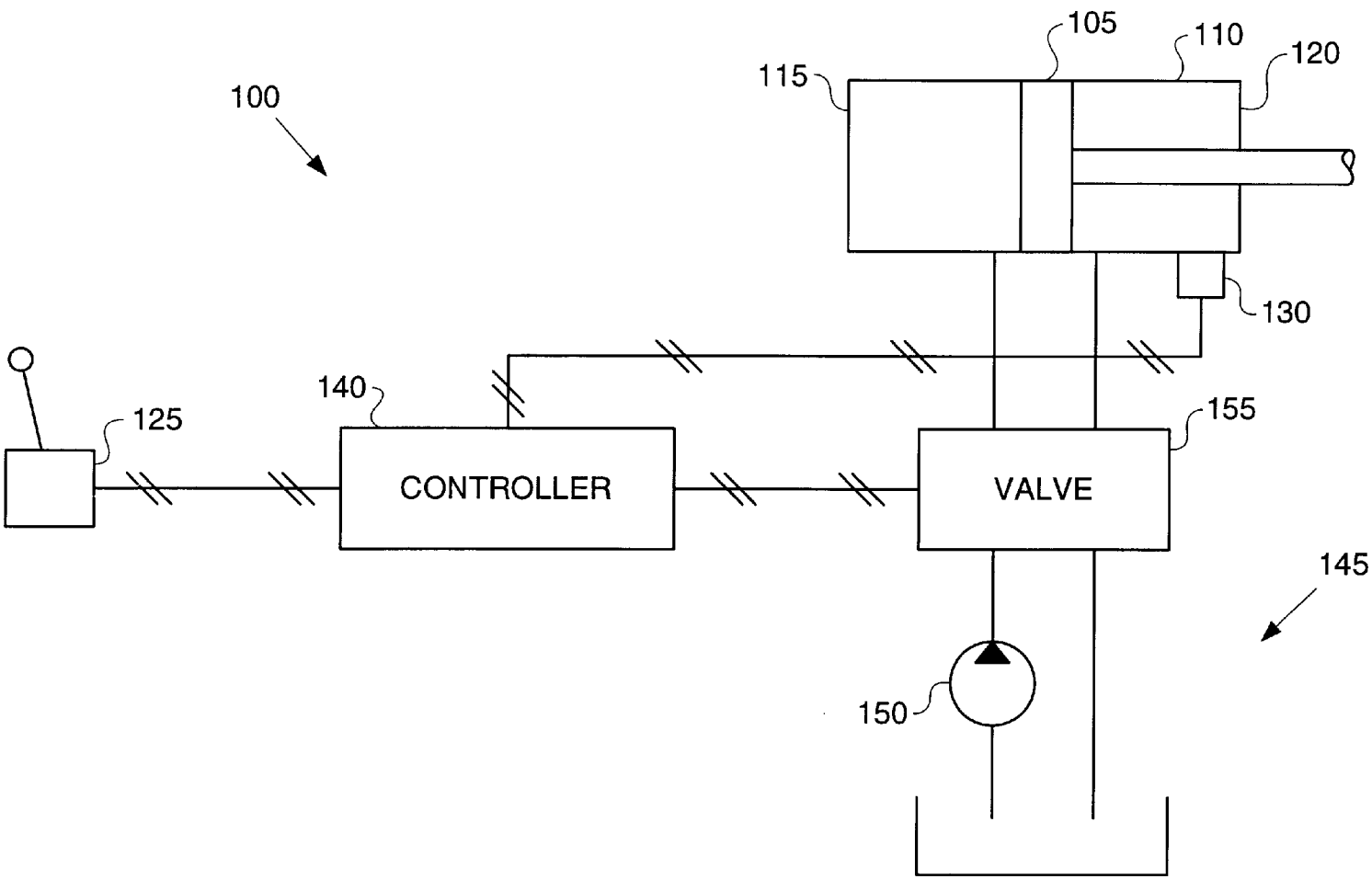
FIG. 1 illustrates an electrohydraulic system for controlling the actuation of a hydraulic cylinder.

With reference to FIG. 1, an apparatus 100 is adapted to control a moveable element 105 within a hydraulic motor 110. In the preferred embodiment, the hydraulic motor 110 is a hydraulic cylinder having a first end 115 and a second end 120, and the moveable element 105 is a piston within the cylinder, as shown.

A lever device 125 establishes an operator command signal indicative of a desired velocity and direction of movement of the piston 105. A position sensor 130 senses the relative position of the piston 105 within the cylinder 110, which is representative of the amount of extension of the cylinder 110, and produces a position signal. The position sensor 105 may measure, either directly or indirectly, the relative extension of the cylinder 110. In one embodiment, the position sensor 130 includes a radio frequency linear position sensor. In another embodiment, the sensor 130 includes a rotary or linear potentiometer. In yet another embodiment, the sensor 130 includes a rotary or linear resolver.

An electronic controller 140 receives the position signal, numerically differentiates the signal and determines the actual velocity of the piston 105. The electronic controller 140 determines a limit value in response to the actual velocity of the piston, compares the operator signal magnitude to the limit value and produces a flow control signal in response to the comparison.

An electrohydraulic controller 145 receives the flow control signal and controls the movement of the piston 105 in accordance with the flow control signal. The electrohydraulic controller 145 includes a source of pressurized fluid represented by a pump 150 and a control valve 155 connected between the pump 150 and the cylinder 110. The control valve 155 regulates or controls the flow of pressurized fluid to the first and second end 115, 120 of the cylinder 110 in response to the flow control signal. In one embodiment, the control valve 155 may include electrically actuatable solenoids that receive the flow control signal and controllably position the spool of the valve 155 to create the desired flow to the cylinder 110. In another embodiment, the control valve 155 may include a main valve adapted to direct pressurized fluid to the cylinder 110 and a pilot valve adapted to direct pilot fluid to the main valve to control the movement of the main valve spool. In this embodiment, the pilot valve would include solenoids that receive the flow control signal.

Preferably, the electronic controller 140 is embodied in a microprocessor based system which utilizes arithmetic units to control process according to software programs. Typically, the programs are stored in read-only memory, random-access memory or the like.

Figure 2:
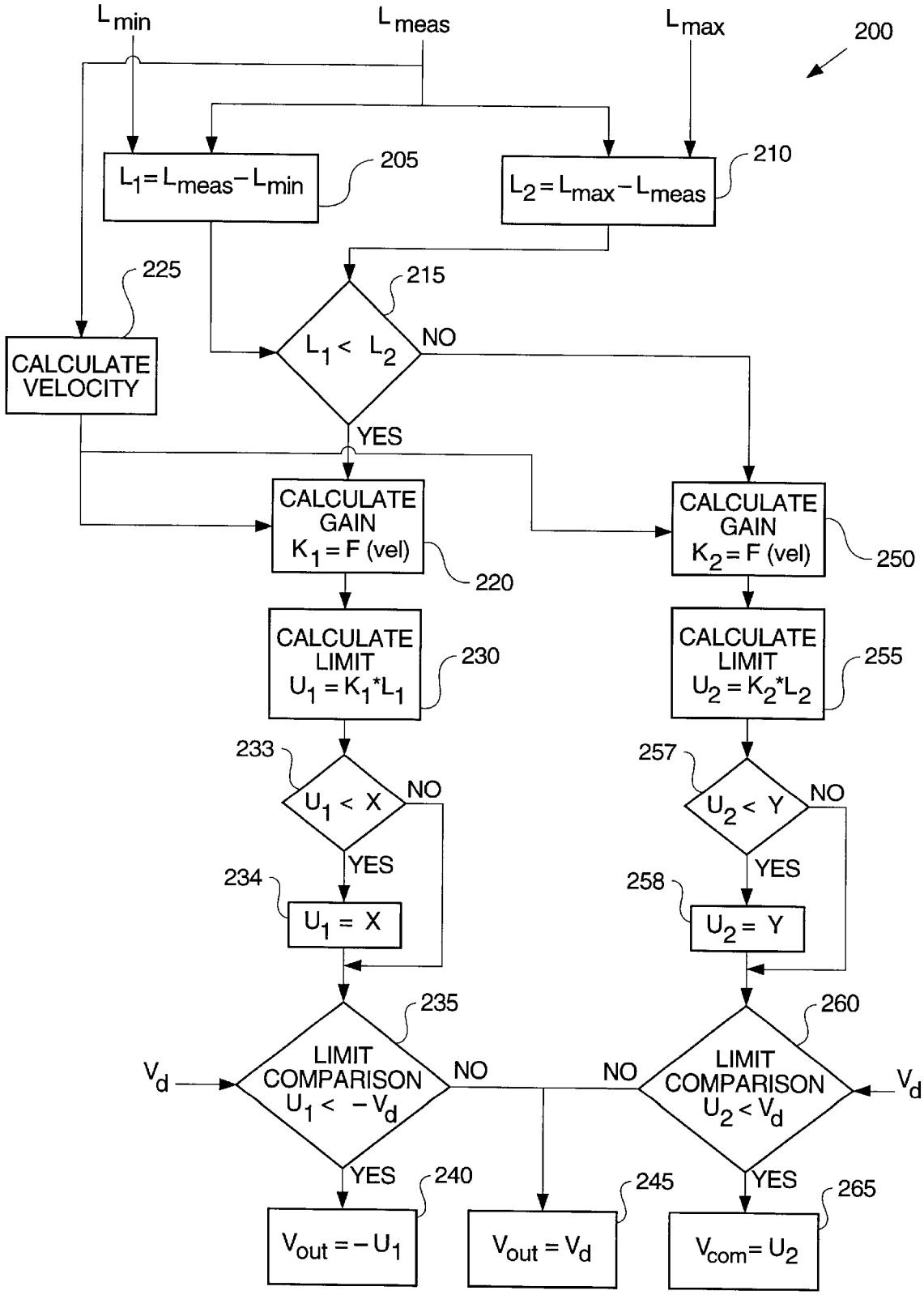
FIG. 2 illustrates a control process for limiting the velocity of the hydraulic cylinder piston as it nears an end of stroke.
Figure 3:
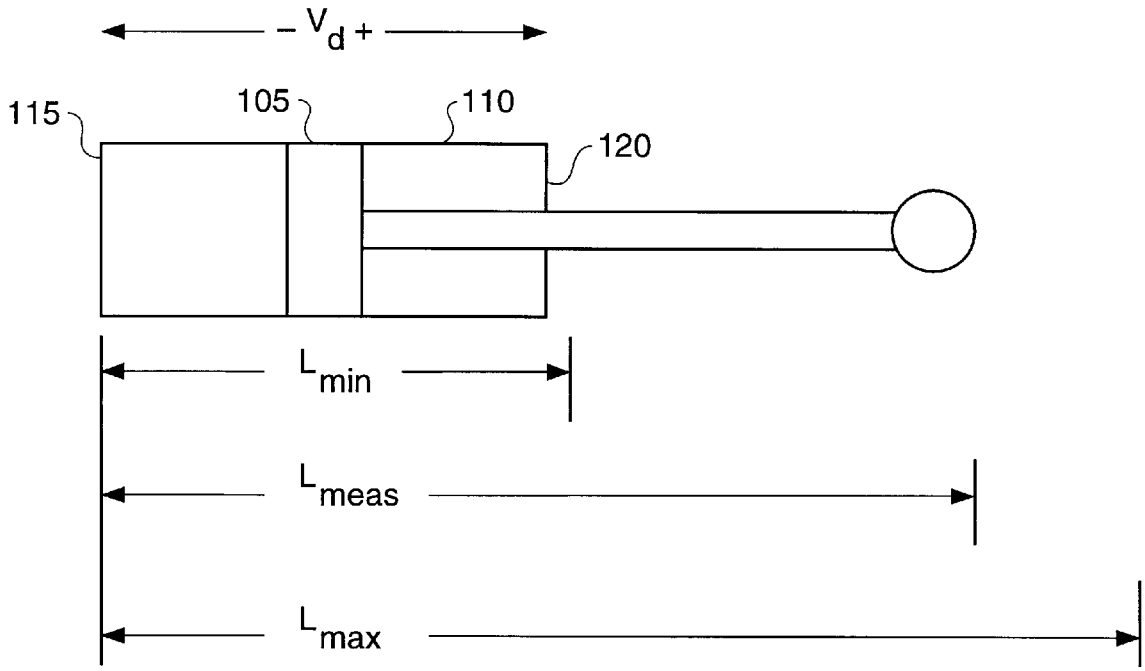
FIG. 3 illustrates variables of the control process in relation to a hydraulic cylinder.

Reference is now made to the flowchart of FIG. 2, which represents the control process of the present invention. The illustrated control process 200 is directed towards limiting the velocity of the piston 105 as the piston 105 approaches either the first or second end 115, 120 of the cylinder 110. In block 205, the electronic controller 140 determines a first region, L1, representing the distance between the piston 105 and the first end 115 of the cylinder 110. The first region is determined by subtracting a value, Lmin, representing a minimum extension of the cylinder 110 from, Lmeas, representing the magnitude of the position signal. In block 210, the electronic controller 140 determines a second region, L2, representing the distance between the piston 105 and the second end 120 of the cylinder 110. The second region is determined by subtracting, Lmeas, from value, Lmax, representing a maximum extension of the cylinder 110. Reference is made to FIG. 3, which shows a pictorial representation of the first and second region.

Referring back to the control process of FIG. 2, the process continues to decision block 215 where the electronic controller 140 compares the magnitude of the first region, L1, to the magnitude of the second region, L2, to determine the region in which the piston 105 is located. If L1 is less than L2, then the piston 105 is said to be in the first region, and the process proceeds to block 220 where a first gain value, K1, is determined. The first gain value is determined as a function of the actual velocity of the piston, which is calculated in block 225. The first limit value, U1, is then determined as shown in block 230, where the first gain value, K1, is multiplied by the value of the first region, L1. The process then continues to decision block 233 where the electronic controller determines if the first limit value, U1, is less then a first minimum velocity value, X. If so, then the first limit value, U1, takes the value of the first minimum velocity value, X, as represented by block 234. The process continues to decision block 235 where the electronic controller compares the first limit value, U1, to the negative of the operator command signal, Vd. Where the first limit value, U1, is less than the negative of the operator command signal, then the piston is said to be moving toward the first end of the cylinder at too high a rate. Consequently, the process continues to block 240 where the electronic controller 140 produces a flow control signal, Vout, having a magnitude equal to the negative of the first limit value to slow the piston 105 as it reaches the first end 115 of the cylinder 110. Otherwise, the process proceeds to block 245 where electronic controller 140 produces a flow control signal having a magnitude equal to the value of the operator command signal.

Referring back to decision block 215, if L1 is equal to or greater than L2, then the piston is said to be in the second region, and the process proceeds to block 250 where a second gain valve, K2, is determined. The second gain value is also determined as a function of the actual velocity of the piston 105. The second limit value, U2, is then determined as shown in block 255, where the second gain value, K2, is multiplied by the value of the first region, L2. The process then continues to decision block 257 where the electronic controller determines if the second limit value, U2, is less then a second minimum velocity value, Y. Note, the second minimum velocity value, Y, may have the same magnitude as the first minimum velocity value, X. If the second limit value, U2, is less then a second minimum velocity value, Y, then the second limit value, U2, takes the value of the second minimum velocity value, Y, as represented by block 258. The process continues to decision block 260 where the electronic controller 140 compares the second limit value, U2, to the magnitude of the operator command signal. Where the second limit value, U2, is less than the magnitude of the operator command signal, i.e., the piston is moving toward the second end 120 of the cylinder 110 at too high a rate, then the process continues to block 265 where the electronic controller 140 produces a flow control signal, Vout, having a magnitude equal to the second limit value to slow the piston as it reaches the second end of the cylinder. Otherwise, the process proceeds to block 245 where electronic controller 140 produces a flow control signal having a magnitude equal to the magnitude of the operator command signal.

Thus, while the present invention has been particularly shown and described with reference to the preferred embodiment above, it will be understood by those skilled in the art that various additional embodiments may be contemplated without departing from the spirit and scope of the present invention.

INDUSTRIAL APPLICABILITY

The present invention is directed toward limiting the velocity of a hydraulic cylinder, 110, or more particularly, limiting the velocity of a hydraulic cylinder piston 110 as it approaches an end of stroke. Advantageously, the present invention compares the commanded cylinder velocity, i.e., the operator command signal to a limit value and limits the commanded cylinder velocity when it has been determined that the piston is moving toward one of the cylinder ends at too high a rate. Advantageously, the limit value is a function of the actual velocity and position of cylinder piston to provide for improved controllability of the cylinder piston.

Other aspects, objects and advantages of the present invention can be obtained from a study of the drawings, the disclosure and the appended claims.

What is claimed is:

1. An apparatus for controllably moving a moveable element within a hydraulic motor, comprising:

a lever device for establishing an operator command signal indicative of a desired velocity and direction of movement of the moveable element;

a position sensor adapted to sense the position of the moveable element and produce a position signal;

an electronic controller adapted to receive the operator command signal and position signal, determine the actual velocity of the moveable element, and determine a limit value in response to the actual velocity and position of the moveable element, wherein the controller compares the operator signal magnitude to the limit value and produces a flow control signal in response to the comparison; and an electrohydraulic controller adapted to receive the flow control signal and responsively control the movement of the moveable element.

2. An apparatus, as set forth in claim 1, wherein the hydraulic motor is a hydraulic cylinder having a first end and a second end, and the moveable element is a piston.

3. An apparatus, as set forth in claim 2, wherein the electronic controller determines a first gain value in response to the hydraulic cylinder piston being near the first end of the hydraulic cylinder and second gain value in response to the hydraulic cylinder piston being near the second end of the hydraulic cylinder.

4. An apparatus, as set forth in claim 3, wherein the electronic controller determines the first and second gain values in response to the actual velocity of the hydraulic cylinder.

5. An apparatus, as set forth in claim 4, wherein the electronic controller determines a first region representing the distance between the piston and the first end of the hydraulic cylinder and a second region representing the distance between the piston and the second end of the hydraulic cylinder.

6. An apparatus, as set forth in claim 5, wherein the electronic controller determines the first limit value in response to the first gain value and the first region and the second limit value in response to the second gain value and the second region.

7. An apparatus, as set forth in claim 6, wherein the first and second limit values are variable above a minimum value.

8. An apparatus, as set forth in claim 7, wherein the electronic controller produces the flow control signal having a magnitude being equal to one of the first limit value in response to piston approaching the first end and being within the first region, and the second limit value in response to piston approaching the second end and being within the second region, otherwise the flow control signal having a magnitude equal to the operator command signal.

9. An apparatus, as set forth in claim 8, wherein the electrohydraulic controller includes a source of pressurized fluid and a control valve being connected between the source of pressurized fluid and the hydraulic cylinder and being adapted to control the flow of pressurized fluid to the hydraulic cylinder in response to the flow control signal.

10. A method for controllably moving a moveable element within a hydraulic motor, comprising the steps of:

establishing an operator command signal indicative of a desired velocity and direction of movement of the moveable element;

sensing the position of the moveable element and producing a position signal;

receiving the operator command signal and position signal, determining the actual velocity of the moveable element, and determining a limit value in response to the actual velocity and position of the moveable element, wherein the controller compares the operator signal magnitude to the limit value and produces a flow control signal in response to the comparison; and receiving the flow control signal and responsively controlling the movement of the moveable element.

11. A method, as set forth in claim 10, including the steps of determining a first gain value in response to the hydraulic cylinder piston being near the first end of the hydraulic cylinder and second gain value in response to the hydraulic cylinder piston being near the second end of the hydraulic cylinder.

12. A method, as set forth in claim 11, including the steps of determining the first and second gain values in response to the actual velocity of the hydraulic cylinder.

13. A method, as set forth in claim 12, including the steps of determining a first region representing the distance between the piston and the first end of the hydraulic cylinder and a second region representing the distance between the piston and the second end of the hydraulic cylinder.

14. A method, as set forth in claim 13, including the steps of determining a first limit value in response to the first gain value and the first region and a second limit value in response to the second gain value and the second region.

15. A method, as set forth in claim 14, wherein the first and second limit values are variable above a minimum value.

16. A method, as set forth in claim 15, including the steps of producing the flow control signal having a magnitude being equal to one of the first limit value in response to piston approaching the first end and being within the first region, and the second limit value in response to piston approaching the second end and being within the second region, otherwise the flow control signal having a magnitude equal to the operator command signal.

17. A method for controllably moving a piston within a hydraulic cylinder, comprising the steps of:

establishing an operator command signal indicative of a desired velocity and direction of movement of the moveable element;

sensing the position of the piston and producing a position signal;

receiving the operator command signal and position signal, determining the actual velocity of the piston, and determining a limit value in response to the actual velocity and position of the piston, wherein the controller compares the operator signal magnitude to the limit value and produces a flow control signal having a magnitude equal to the lessor of the operator command signal and limit value; and receiving the flow control signal and responsively controlling the movement of the piston.

* * * * *